US006506976B1

(12) United States Patent
Neveux, Jr.

(10) Patent No.: US 6,506,976 B1
(45) Date of Patent: Jan. 14, 2003

(54) ELECTRICAL CABLE APPARATUS AND METHOD FOR MAKING

(75) Inventor: Paul Emilien Neveux, Jr., Loganville, GA (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/396,682

(22) Filed: Sep. 14, 1999

(51) Int. Cl.[7] ..... H01B 7/00
(52) U.S. Cl. ..... 174/113 R; 174/113 C
(58) Field of Search ..... 174/36, 113 R, 174/113 A, 113 AS, 113 C, 27

(56) References Cited

U.S. PATENT DOCUMENTS

| | | | | | |
|---|---|---|---|---|---|
| 1,883,269 | A | | 10/1932 | Yonkers | |
| 1,976,847 | A | * | 10/1934 | Gordon et al. | 173/264 |
| 3,622,683 | A | * | 11/1971 | Roberts et al. | 174/36 |
| 3,848,073 | A | * | 11/1974 | Simons et al. | 174/36 |
| 4,034,148 | A | * | 7/1977 | Lang | 174/34 |
| 4,920,234 | A | * | 4/1990 | Lemke | 174/36 |
| 5,132,488 | A | * | 7/1992 | Tessier et al. | 174/34 |
| 5,149,915 | A | | 9/1992 | Brunker et al. | 174/36 |
| 5,286,923 | A | * | 2/1994 | Prudhon et al. | 174/113 R |
| 5,519,173 | A | | 5/1996 | Newmoyer et al. | 174/113 |
| 5,574,250 | A | * | 11/1996 | Hardie et al. | 174/36 |
| 5,658,406 | A | * | 8/1997 | Walling et al. | 156/51 |
| 5,789,711 | A | * | 8/1998 | Gaeris et al. | 174/113 C |
| 5,821,467 | A | * | 10/1998 | O'Brien et al. | 174/117 F |
| 5,952,615 | A | * | 9/1999 | Prudhon | 174/113 C |
| 5,969,295 | A | * | 10/1999 | Boucino et al. | 174/113 C |
| 6,091,025 | A | * | 7/2000 | Cotter et al. | 73/110 R |
| 6,147,309 | A | * | 11/2000 | Mottine et al. | 174/110 PM |
| 6,150,612 | A | * | 11/2000 | Grandy et al. | 174/113 C |
| 6,162,992 | A | * | 12/2000 | Clark et al. | 174/113 R |
| 6,248,954 | B1 | * | 6/2001 | Clark et al. | 174/113 R |

FOREIGN PATENT DOCUMENTS

| | | |
|---|---|---|
| GB | 669404 | 4/1952 |

* cited by examiner

*Primary Examiner*—Dean A. Reichard
*Assistant Examiner*—William H. Mayo, III
(74) *Attorney, Agent, or Firm*—Thomas, Kayden, Horstemeyer & Risley, LLP

(57) ABSTRACT

Embodiments of the invention include an electrical cable apparatus and method for making. The electrical cable apparatus includes a plurality of paired conductive elements, a dielectric jacket formed around the plurality of paired conductive elements, and at least one dielectric film separating the pairs of conductive elements within the dielectric jacket. For example, for an arrangement having four twisted pair of copper wires within an electrically insulating jacket, two dielectric films surround alternating pairs of individually insulated conductor elements. The dielectric film is made of one or more of the following materials: ethylchlorotrifluoroethylene (ECTFE or HALAR®), poly(vinyl chloride) (PVC), polyolefins, and fluoropolymers including fluorinated ethylene-propylene (FEP or TEFLON®), perfluoroalkoxy polymers of tetrafluoroethylene and either perfluoropropyl ether (PFA) or perfluoromethylvinyl ether (MFA). Alternatively, the dielectric film is made of woven glass yarn tape such as KAPTON®. The dielectric film has a width, e.g., of approximately 0.125 to 0.250 inch and a thickness, e.g., of approximately 2 to 20 mils (0.002 to 0.020 inch). Alternatively, a dielectric film is positioned between individual conductive elements within the conductor pairs. The method for making an electrical cable includes providing a plurality of the paired conductive elements, forming the dielectric film around one or more of the conductor pairs and/or forming the dielectric film between the individual conductors within one or more conductor pairs, and forming the dielectric jacket around the conductor pairs. The thin dielectric film provides separation between conductor pairs and/or between individual conductors within conductor pairs to reduce crosstalk therebetween.

6 Claims, 3 Drawing Sheets

ELECTRICAL CABLE APPARATUS AND METHOD FOR MAKING

BACKGROUND OF THE INVENTION

1. Field of the Invention

The invention relates to electrical cabling. More particularly, the invention relates to reducing cross-talk in electrical cabling.

2. Description of the Related Art

Within electrical cable such as that used in a local area network (LAN), the reduction of crosstalk remains an ongoing problem for the communication industry. Conventionally, within an electrical cable that typically contains a plurality of twisted pair of individually insulated conductors such as copper wires, many configurations and techniques have been implemented to reduce crosstalk between the respective electrically conducting pairs.

For example, one of the most useful techniques for reducing crosstalk within electrical cabling includes separating parallel and adjacent transmission lines. In this manner, numerous components such as spacer elements have been included in the electrical cable to maintain sufficient spacing between the conducting pairs and thus reduce cross-talk therebetween. See, U.S. Pat. Nos. 4,920,234 and 5,149,915.

Because typical communications industry electrical cables include four twisted pair, many spacer element configurations comprise one or more centrally-located spacer elements, such as a dielectric flute, with the twisted pairs arranged in various configurations therearound. See, e.g., U.S. Pat. Nos. 5,132,488 and 5,519,173.

However, these conventional cable arrangements aimed at reducing crosstalk often are burdened with other problems. For example, existing spacer elements are relatively inflexible and thus restrict movement of the twisted pairs within the electrical cable. Also, existing spacer elements are relatively expensive and difficult to handle and manipulate during the electrical cabling manufacturing process.

Accordingly, it would be desirable to have an electrical cabling apparatus and method for making that addresses the aforementioned concerns.

SUMMARY OF THE INVENTION

The invention is embodied in an electrical cable apparatus and method for making. The electrical cable apparatus comprises a plurality of paired conductive elements, a dielectric jacket formed around the plurality of paired conductive elements, and at least one dielectric film separating the pairs of conductive elements within the dielectric jacket. For example, for an arrangement having four twisted pair of copper wires within an electrically insulating jacket, embodiments of the invention include two dielectric films surrounding alternating pairs of individually insulated conductor elements. Alternatively, embodiments of the invention include a dielectric film formed helically between individual conductive elements within the conductor pairs. The dielectric film is made of one or more of the following materials: ethylchlorotrifluoroethylene (ECTFE or HALAR®), poly(vinyl chloride) (PVC), polyolefins, and fluoropolymers including fluorinated ethylene-propylene (FEP or TEFLON®), perfluoroalkoxy polymers of tetrafluoroethylene and either perfluoropropyl ether (PFA) or perfluoromethylvinyl ether (MFA). Alternatively, the dielectric film is made of woven glass yarn tape such as KAPTON®.

The dielectric film has a width, e.g., of approximately 0.125 to 0.250 inch and a thickness, e.g., of approximately 0.002 to 0.020 inch (2 to 20 mils).

According to embodiments of the invention, a method for making an electrical cable comprises providing a plurality of the paired conductive elements, forming the dielectric jacket around the conductor pairs, and forming the dielectric film around one or more of the conductor pairs. Alternatively, the method comprises providing a plurality of the paired conductive elements, forming the dielectric jacket around the conductor pairs, and forming the dielectric film helically between the individual conductors within one or more conductor pairs. The thin dielectric film provides separation between conductor pairs and/or between individual conductors within conductor pairs to reduce crosstalk therebetween.

DETAILED DESCRIPTION

Figure 1:
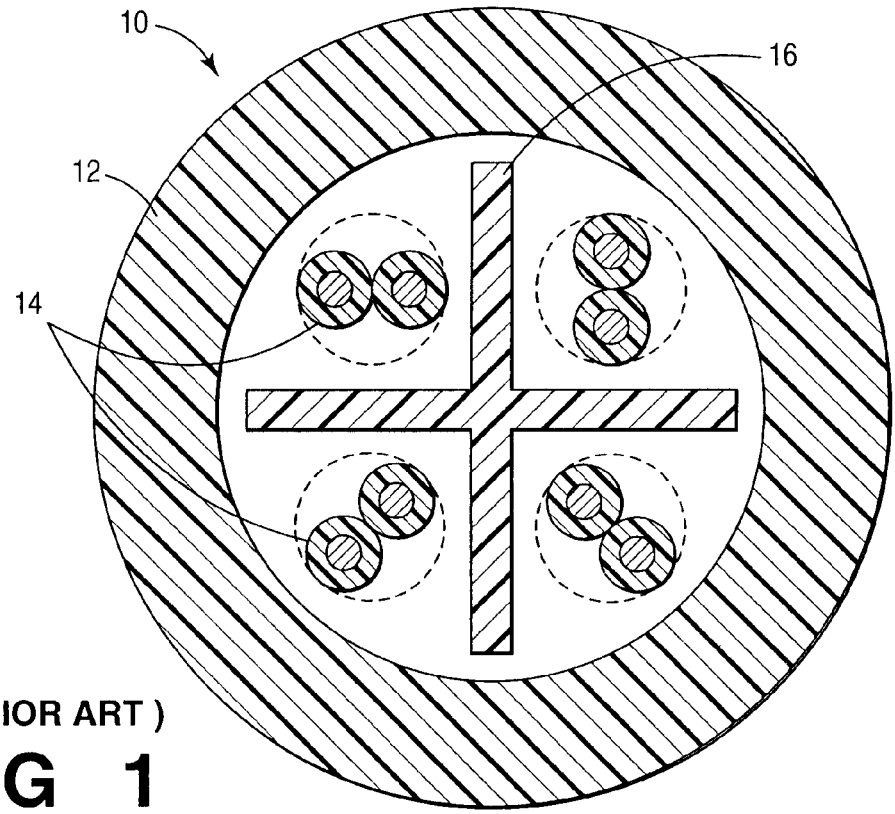
( PRIOR ART ) FIG 1
FIG. 1 is a cross-sectional view of an electrical cable according to a conventional arrangement.

In the following description similar components are referred to by the same reference numeral in order to enhance the understanding of the invention through the description of the drawings.

Although specific features, configurations and arrangements are discussed hereinbelow, it should be understood that such is done for illustrative purposes only. A person skilled in the relevant art will recognize that other steps, configurations and arrangements are useful without departing from the spirit and scope of the invention.

Electrical cabling such as that used in a local area network (LAN) continues to suffer adversely from the reactive effects of parallel and adjacent conductors, e.g., inductive and capacitive coupling, also known as "crosstalk". Conventional electrical cabling includes a jacket containing a plurality of twisted pairs of individually insulated conductors such as copper wires. However, as the number of conductor pairs within an electrical cable increases, more potential exists for crosstalk interference. Furthermore, crosstalk becomes more severe at higher frequencies, at higher data rates, and over longer distances. Thus, crosstalk effectively limits the useful frequency range, bit rate, cable length, signal to noise (s/n) ratio and number of conductor pairs within a single electrical cable for signal transmission. Moreover, crosstalk often is more pronounced in bi-directional transmission cables. Such effect is known as "near end crosstalk" (NEXT), and is particularly noticeable at either end of the cable where signals returning from the opposite end are weak and easily masked by interference.

It is known that, in general, crosstalk is better controlled by separating parallel and adjacent transmission lines or by transposing the signals along the cable to minimize the proximity of any two signals. Accordingly, many electrical cable arrangements exist that include spacer elements to maintain sufficient spacing between the conducting pairs and thus reduce cross-talk therebetween. As mentioned previously herein, see, e.g., U.S. Pat. Nos. 4,920,234; 5,149,915; 5,132,488; and 5,519,173.

Referring now to FIG. 1, shown is a conventional electrical cable 10 having an arrangement aimed at reducing crosstalk. The electrical cable 10 comprises a jacket 12, made of a suitable polymeric material, surrounding four pair of individually insulated conductors or conductive elements 14 separated by a spacer or spacer means 16. The individually insulated conductor pairs typically comprise twisted pairs of copper wire, and the spacer means 16 typically is made of a suitable dielectric material such as poly(vinyl chloride) (PVC).

In operation, the spacer means 16 maintains substantially constant spacing between the conductor pairs along the length of the electrical cable. In this manner, crosstalk is reduced therebetween. For example, when only two of four twisted pair are active, typically alternating conductor pairs are active to inherently reduce crosstalk. That is, for an electrical cable arrangement of four twisted pair of conductors and each twisted pair generally occupying a different quadrant within the electrical cable jacket, typically the first and third pairs are active and the second and fourth pairs are inactive. In this manner, a certain degree of spacing for reducing crosstalk is inherent in the specific arrangement of the electrical cable.

Although such conventional arrangements may reduce crosstalk to a certain degree, many of these conventional cable arrangements aimed at reducing crosstalk often are burdened with other problems, as discussed previously herein. For example, many spacer means 16 are relatively inflexible and thus restrict movement of the conductor pairs within the electrical cable. Also, the inflexibility of the spacer means 16 makes them difficult to handle and incorporate into the electrical cables during fabrication of the electrical cable. Furthermore, many spacer means 16 are relatively expensive and contribute significantly to the overall cost of the cable.

Figure 2:
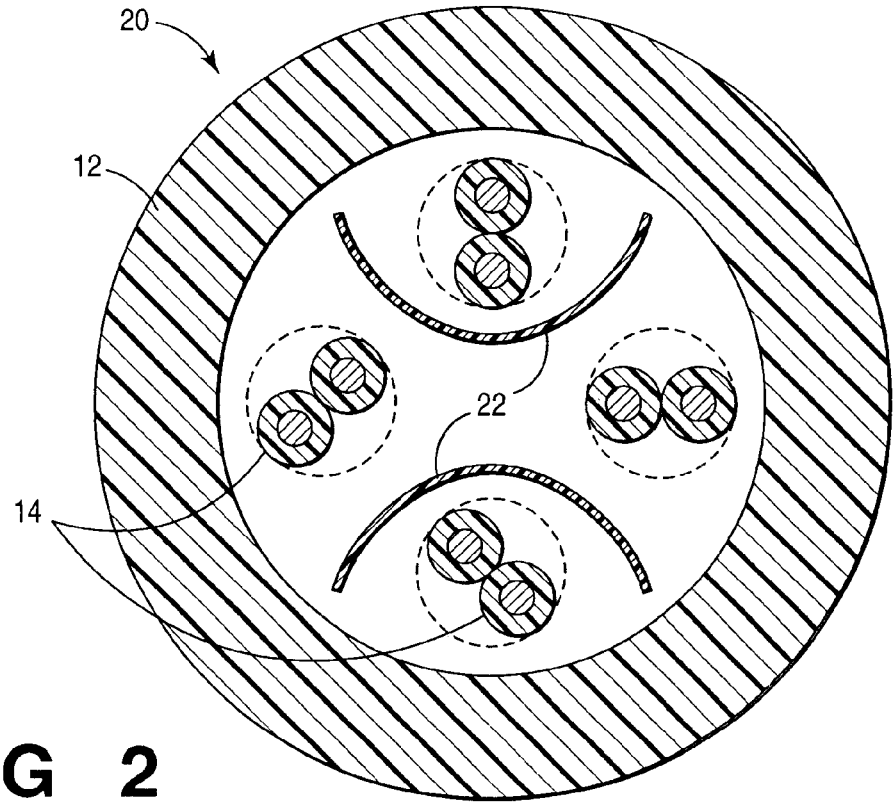
FIG. 2 is a cross-sectional view of an electrical cable according to an embodiment of the invention.

Referring now to FIG. 2, an electrical cable 20 according to embodiments of the invention is shown. The electrical cable 20 includes a jacket 12 formed around a plurality of pairs of individually insulated conductors or conductive elements 14, typically four pair as shown. The jacket 12 is made of any suitable flexible, electrically insulating material, e.g., a fluoropolymer, poly(vinyl chloride) (PVC), a polymer alloy or other suitable polymeric material. The conductors pairs, which typically are twisted pairs of copper wire, are individually insulated with, e.g., polyolefin, flame retardant polyolefin, fluoropolymer, PVC, a polymer alloy or other suitable polymeric material.

According to embodiments of the invention, spacing between the conductor pairs is maintained by a dielectric film 22 advantageously positioned around particular conductor pairs. The dielectric film 22 includes material such as, e.g., KAPTON® film (polyimide) woven glass yam tape, ethylchlorotrifluoroethylene (ECTFE or HALAR®), poly (vinyl chloride) (PVC), polyolefins and fluoropolymers including fluorinated ethylene-propylene (FEP or TEFLON®), perfluoroalkoxy polymers of tetrafluoroethylene and either perfluoropropyl ether (PFA) or perfluoromethylvinyl ether (MFA) or other suitable electrically insulating material. The dielectric film has a width, e.g., of approximately 0.125 to approximately 0.250 inch and a thickness, e.g., of approximately 0.002 to approximately 0.020 inch (2 to 20 mils).

The thin dielectric film 22 is advantageous in that it reduces crosstalk. However, its flexible construction and material smoothness also allows it to slide relatively easily with respect to other components in the electrical cable jacket, including the conductors 14 and other dielectric films. Also, as will be discussed in greater detail hereinbelow, the size and shape of the dielectric film 22 makes it relatively easy to manufacture and incorporate into existing electrical cable fabrication processes. In this manner, the thin dielectric film 22 compares favorably with, e.g., the bulky, inflexible flute used in conventional configurations.

According to the embodiment shown in FIG. 2, for an electrical cable 20 having four conductor pairs, two thin dielectric films are positioned around alternating conductor pairs (e.g., the first and third pairs) in such a manner that the spacing between adjacent conductor pairs is substantially constant along the length of the cable. In this manner, the conductor pairs are separated to the extent that the conductor pairs generally occupy separate quadrants within the electrical cable 20.

It should be noted that the particular arrangement shown in FIG. 2 is for illustration purposes only and is not meant to be a limitation of the invention. Thus, although in this particular embodiment four conductor pairs and two dielectric films are shown, such is not necessary according to embodiments of the invention. That is, it is within the scope of embodiments of the invention to have an electrical cable with as few as two conductor pairs and a single dielectric film. Also, it is possible to have an electrical cable with many more than four conductor pairs and more than two dielectric films separating them. Regardless of the particular configuration, one or more dielectric films are used to separate conductor pairs to reduce crosstalk therebetween, in accordance with embodiments of the invention.

Figure 3:
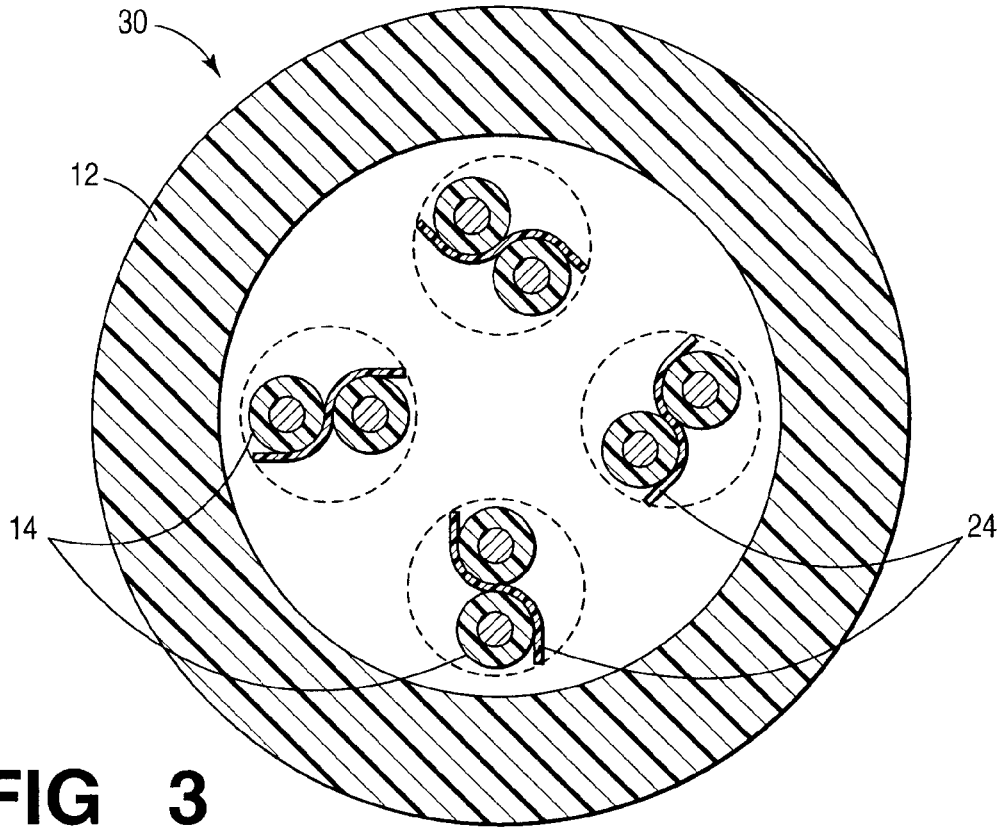
FIG. 3 is a cross-sectional view of an electrical cable according to an alternative embodiment of the invention.

For example, referring now to FIG. 3, an electrical cable 30 according to an alternative embodiment of the invention is shown. In this embodiment, a dielectric film 24 is positioned between the individual conductors 14 within the conductor pair, rather than between conductor pairs (as shown in FIG. 2). Typically, the paired conductors 14 further comprise twisted pairs of individual conductive elements 14, and thus the dielectric film 24 is woven helically between the individual conductive elements 14 within a given twisted pair. In this manner, the dielectric film 24 maintains spacing between the individual conductive elements along the length of the cable 30. Also, stranding tension within the cable 30 and friction between the conductive elements within a given conductor pair and the dielectric film maintains separation between adjacent conductor pairs.

Figure 4:
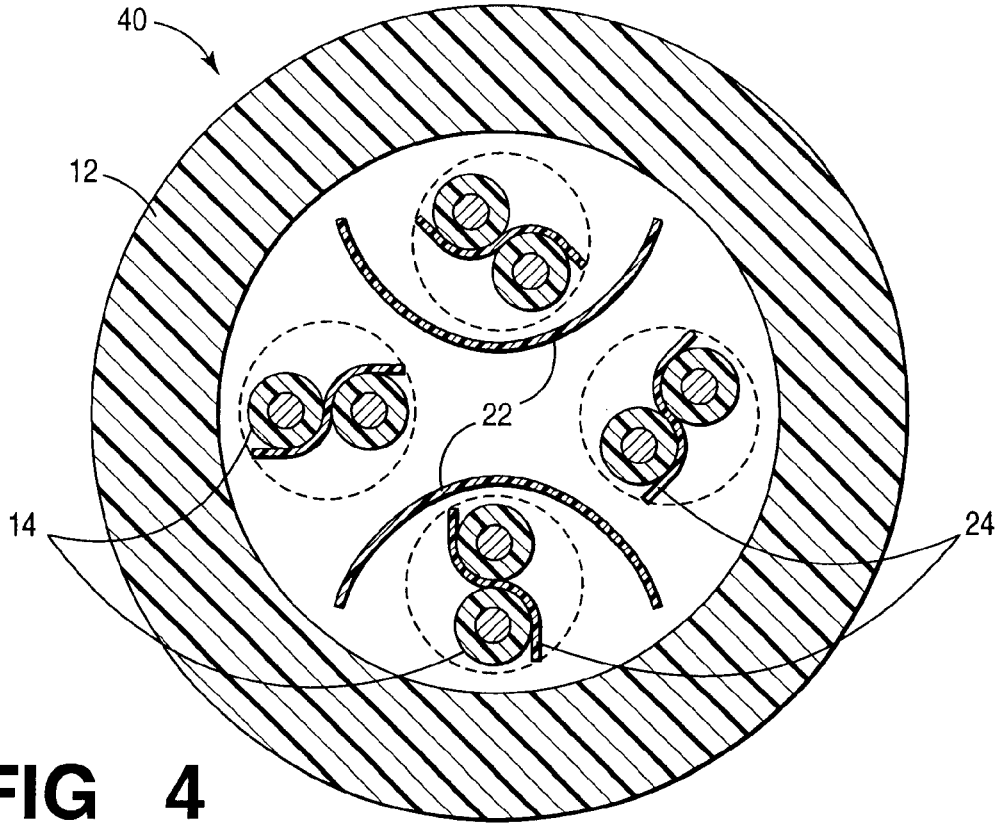
FIG. 4 is a cross-sectional view of an electrical cable according to another alternative embodiment of the invention.
Figure 5:
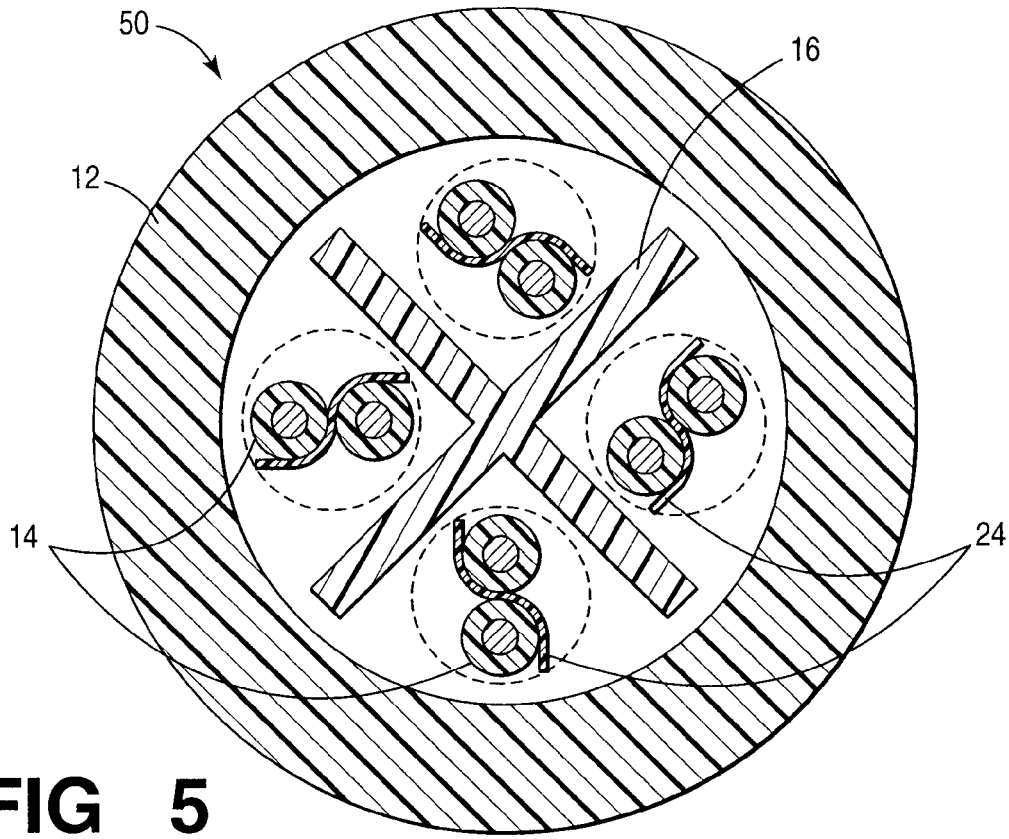
FIG. 5 is a cross-sectional view of an electrical cable according to yet another alternative embodiment of the invention.

Referring now to FIG. 4, yet another embodiment of the invention is shown. In this embodiment, the configuration of dielectric films shown in FIG. 3 is used together with the dielectric film configuration shown in FIG. 2. In this embodiment, dielectric films 24 maintain spacing between individual conductors within conductor pairs and dielectric films 22 maintain spacing between conductor pairs. Alternatively, as shown in FIG. 5, the use of dielectric films 24 between individual conductors within conductor pairs is useful with conventional spacing means 16, e.g., a plastic flute configured as shown.

The various internal configurations of electrical cables shown in FIGS. 2–4 are generated, e.g., by a conventional stranding machine, which takes the various internal components from a plurality of spools and guides them into the desired arrangement. Also, an extruder extrudes the protective jacket over what is to be the internal arrangement either simultaneously or shortly thereafter. Because the advantageous dielectric films are relatively thin and flexible, they are compatible with conventional stranding machines and thus are easily incorporated into the existing fabrication processes.

Figure 6:
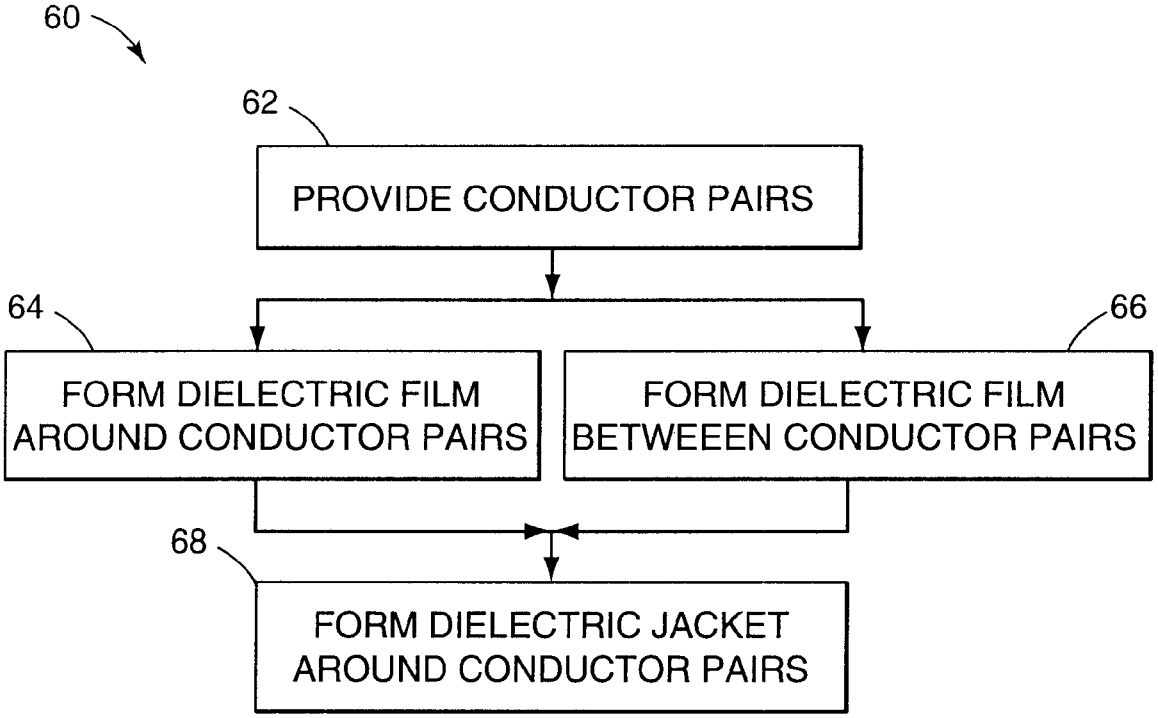
FIG. 6 is a simplified block diagram of a method for making an electrical cable according to embodiments of the invention.

Referring now to FIG. 6, with continuing reference to FIGS. 2–4, a method 60 for making an electrical cable according to embodiments of the invention is shown. The method 60 includes a first step 62 of providing the conductor pairs, e.g., four pair of individually insulated twisted copper wire.

The next step 64 is to form the dielectric film 22 around one or more conductor pairs, depending on the particular conductor pair configuration. For example, with an electrical cable having four conductor pairs, the step 64 includes forming dielectric films around alternating conductor pairs (e.g., the first and third conductor pairs), as shown in FIG. 2. The forming step 64 is performed, e.g., in a conventional manner using conventional pay-off reels that pay-off the conductor pairs and the dielectric film to a stranding lay plate for appropriate configuration of the conductor pairs and the dielectric film. Once configured, the twisted configuration is taken up by an appropriate take-up reel.

Alternatively, the method 60 includes a step 66 of forming the dielectric film 24 between the individual conductors within a conductor pair, rather than between conductor pairs. Such alternative embodiment is shown, e.g., in FIG. 3. Again, such step is performed, e.g., using conventional equipment such as pay-off reels, lay plates and take-up reels.

The next step 68 includes forming the dielectric jacket around the conductor pairs, e.g., by extruding a suitable polymeric material around the conductor pair arrangement. The extrusion is performed, e.g., in a conventional manner.

It will be apparent to those skilled in the art that many changes and substitutions can be made to the embodiments of the electrical cabling described herein without departing from the spirit and scope of the invention as defined by the appended claims and their full scope of equivalents. For example, although many of the illustrative embodiments hereinabove show only four pair of twisted conductors, embodiments of the invention are useful in many other twisted pair arrangements. That is, according to embodiments of the invention, thin dielectric films as disclosed hereinabove are useful in electrical cables having any number of twisted pair arrangements. Also, it is possible to use the dielectric film along with various other conventional arrangements, including central spacing means and circumferential spacing means.

What is claimed is:

1. An electrical cable, comprising:

a plurality of paired conductive elements;

a dielectric jacket formed around the plurality of paired conductive elements;

at least tow dielectric films each formed around at least one pair in the plurality of paired conductive elements in order to separate the pairs of conductive elements within the dielectric jacket, wherein each of the at least two dielectric films does not form an enclosed space; and at least one dielectric film separating the conductive elements within at least one of the plurality of paired conductive elements.

2. The electrical cable, comprising:

a plurality of pairs of conductive elements;

a dielectric jacket formed around the plurality of pairs of conductive elements; and a plurality of dielectric films corresponding to the plurality of pairs of conductive elements, wherein each dielectric film separates the conductive elements within its corresponding pair of conductive elements.

3. The method for making an electrical cable; said method comprising the steps of:

providing a plurality of paired condictive elements;

forming a dielectric jacket around the plurality of paired conductive elements;

forming at least two dielectric films each formed around at least one pair in the plurality of paired conductive elements in order to separate the pairs of conductive elements within the dielectric jacket, wherein each of the at least two dielectric films does not form an enclosed space; and forming a dielectric film between the conductive elements in at least one pair of the plurality of paired conductive elements.

4. A method for making an electrical cable, said method comprising the steps of:

providing a plurality of pairs of conductive elements;

forming a dielectric jacket around the plurality of pairs of conductive elements;

providing a plurality of dielectric films corresponding to the plurality of conductive elements; and forming a dielectric film from the plurality of dielectric films helically beteween each of the conductive elements in the corresponding pair of conductive elements.

5. An electrical cable, comprising:

a plurality of paired conductive elements;

a dielectric jacket formed around the plurality of paired conductive elements;

at least one dielectric film separating the pairs of conductive elements within the dielectric jacket, wherein at least one dielectric film has a width within the range of approximately 0.125 inch to approximately 0.190 inch and a thickness within the range from approximately 0.0005 to approximately 0.020 inch; and at least one dielectric film separating the conductive elements within at least one of the plurality of paired conductive elements.

6. A method for making an electrical cable, said method comprising the steps of:

providing a plurality of paired conductive elements;

forming a dielectric jacket around the plurality of paired conductive elements;

forming at least one dielectric film around at least one pair of conductive elements to separate the pairs of conductive elements within the dielectric jacket wherein the at least one dielectric film has a width the range of approximately 0.125 inch to approximately 0.190 inch and a thickness within the range of approximately 0.005 to approximately 0.020 inch; and forming at least one dielectric film between the conductive elements in at least one pair of conductive elements.

* * * * *